United States Patent [19]

Barton

[11] Patent Number: 5,036,777

[45] Date of Patent: Aug. 6, 1991

[54] PORTABLE FOLDING IRONING BOARD

[76] Inventor: Glenn Barton, 520 S. Sepulveda Blvd., Ste. 407, Los Angeles, Calif. 90049

[21] Appl. No.: 294,194

[22] Filed: Jan. 6, 1989

[51] Int. Cl.[5] ..... A47B 13/08

[52] U.S. Cl. ..... 108/90; 108/97

[58] Field of Search ..... 108/90, 97, 135, 152, 108/47, 48, 49, 112; 38/138, 134, 108, 104, 140; 297/174

[56] References Cited

U.S. PATENT DOCUMENTS

| | | | |
|---|---|---|---|
| 503,410 | 8/1893 | Everett | 108/97 |
| 918,148 | 4/1909 | Headly | 108/97 |
| 1,197,525 | 9/1916 | Meibert | 38/139 |
| 2,493,187 | 1/1952 | Ducoy | 297/174 |
| 2,499,078 | 2/1958 | Shaw | 108/112 |
| 2,637,919 | 5/1953 | Buchanan | 38/138 |
| 2,640,597 | 6/1953 | Thomson | 108/47 X |
| 2,874,471 | 2/1959 | Palmer | 38/140 |
| 3,057,500 | 9/1962 | Hyde | 297/174 X |
| 3,126,226 | 3/1964 | Johnson | 297/174 |
| 3,301,406 | 1/1967 | Scott | 108/97 |

*Primary Examiner*—Jose V. Chen
*Attorney, Agent, or Firm*—William C. Fuess

[57] ABSTRACT

A rectangular planar plastic member unfolds by a piano hinge along one of its edge sides from a trapezoidal planar plastic member in order to form a coplanar flat top surface suitable for ironing. The bottom side of the rectangular planar member presents two elongate bores. The bores are preferably spaced parallel to each other and to the flat top surface, and are also aligned transversely to that edge side of the rectangular planar member which is opposite the piano hinge. The bores have open ends that are directionally disposed toward the piano hinge. Two generally "U"-shaped elongate tubular brace members both slide and rotate within the bores. The brace members rotate from storage positions folded against the bottom side of the rectangular planar member to deployed positions where the plane of each "U" is perpendicular to the planar member. A leg of each brace member retained within a corresponding bore is then slid relatively more deeply within its bore, causing the other leg of each brace member to extend beyond the edge side of the rectangular planar member. The ironing board is temporarily removably mounted to the planar level lip of an independent structure such as a table by placing the underside of the rectangular planar member on the top surface of the lip while the two brace members brace against the bottom surface of the lip.

14 Claims, 2 Drawing Sheets

FIG. 1
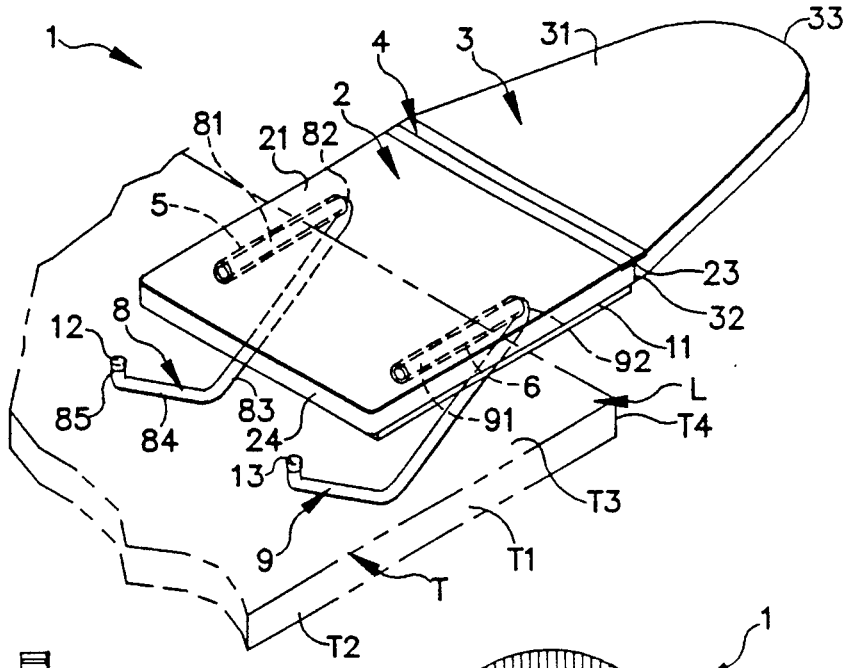
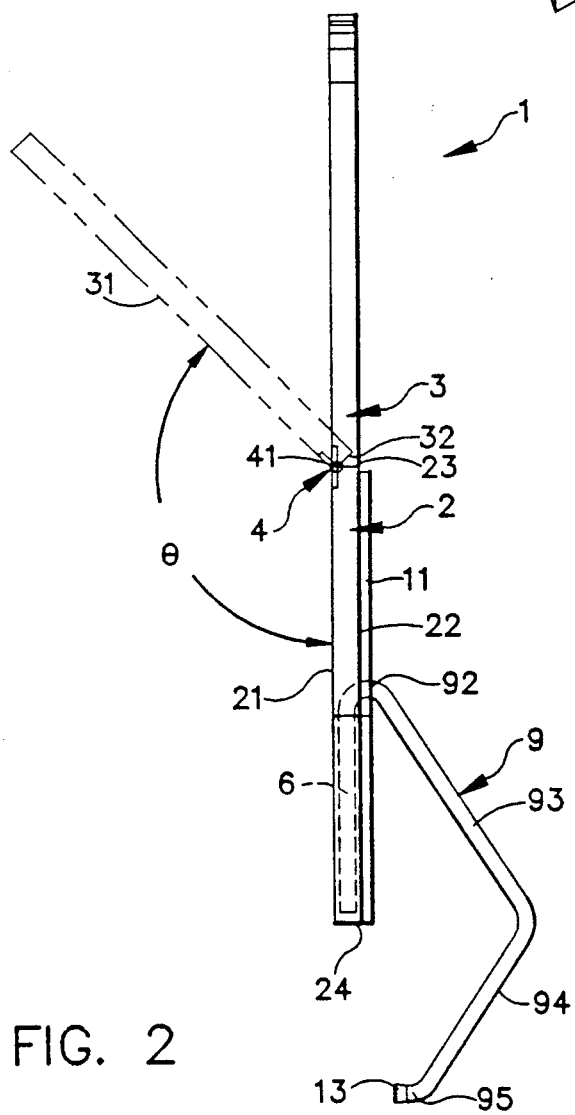
FIG. 2
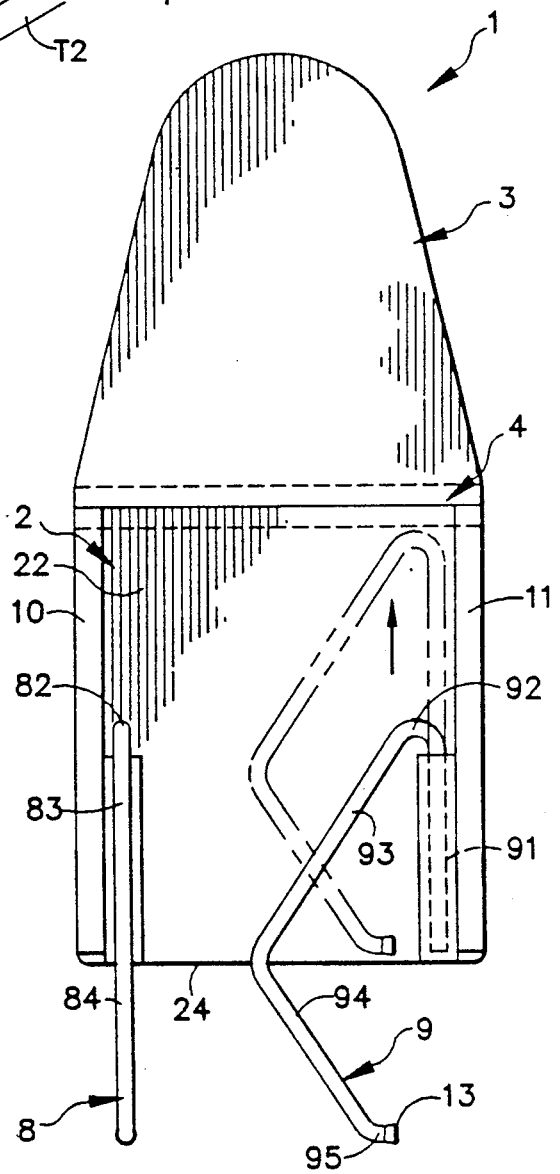
FIG. 3

PORTABLE FOLDING IRONING BOARD

BACKGROUND OF THE INVENTION

1. Field of the Invention

The present invention concerns portable and foldable ironing boards, particularly those that are supported during use on an independent structure that presents a substantially planar substantially level lip. The present invention further concerns a system for temporarily mounting a portable object in a position at, and extending into space beyond, the substantially planar substantially level lip of an independent structure.

2. Background of the Invention

Most common household iron boards are folding in the sense that the legs that support the ironing board may be drawn proximate to the planar surface of the ironing board. Folding makes the ironing board more compact for storage between periods of use.

A small ironing board for use by travelers is also commonly foldable. For this type of ironing board the planar ironing surface is normally folded in half in order to reduce its longitudinal extent. When folded a traveler's ironing board can commonly be put into a trunk or suitcase for transportation to, and use at, various locations that the traveler may visit.

A small, compact, lightweight, and foldable ironing board is generally useful to occupants of a hotel, dormitory, rooming house, nursing home, or other institution who may not have ready access to, and ability to store, a conventional household ironing board.

A portable ironing board for use by travelers and/or in an institutional setting would desirably be designed to advantage itself of existing structures, particularly furniture, that are present within a hotel or institution in order to support the ironing board surface. An ironing board supported by existing structures could save the weight and space of having a dedicated support base, or legs. For example, many tables, bureaus, dressers, and other items of furniture that are commonly and widely used in hotels, dormitories, nursing homes, and other institutions present, at some elevation above floor level, a substantially planar substantially level lip. These lips on tables and other furniture are normally sufficiently strong so as to conveniently and effectively support an ironing board, should an ironing board be designed to be temporarily mountable thereto.

Certain design and engineering challenges will attend any attempt to mount an ironing board at the lip of a table or other piece of furniture. If an ironing board is to be mounted at, or upon, the lip or other portion of an existing structure such as a table, then it is desirable to maintain adequate clearance and operational space for each of (i) the cloth being ironed, (ii) the ironing instrument, and (iii) the person performing the ironing. Although even a simple ironing pad laid upon a planar table top will present a surface on which it is suitable to iron cloth with an ironing instrument, such an approach does not preserve the desired clearances and space for ironing.

It is also desirable that the substantial characteristics of a conventional free-standing ironing board should be preserved in any portable ironing board that is mounted to furniture. These characteristics include the generally elongate generally trapezoidal shape of the ironing board's surface, the support of the ironing board's surface at a convenient elevation and with a convenient access so that it may be readily approached and worked over during the ironing of cloth, and the generally stable and reliable mechanical support of the ironing board surface.

It is still further desirable that portable ironing board that mounts to furniture or other structures should not mar, deform, or otherwise damage or alter such structures. Nonetheless to this requirement, a portable ironing board should not be supported upon and mounted to furniture or other structures so loosely or insubstantially that it might topple or otherwise prove unsafe when used with a hot iron.

Issued United States patents show portable and foldable ironing boards. U.S. Pat. No. 927,408 for an IRONING BOARD shows a non-foldable ironing board that presents a rearwardly disposed hooking mechanism for engaging the extended lip of a table or the like. The hooking mechanism imparts stability. However, it is not sufficiently extensive so as to completely support the ironing board from the table: a support strut, or leg, is additionally required.

U.S. Pat. No. 1,197,525 for an IRONING BOARD shows a compact foldable ironing board that is braced in its extended, erected, position by rods that are slidably carried in eye bolts.

U.S. Pat. No. 2,499,078 for an FOLDING IRONING BOARD shows a portable folding ironing board having a supporting structure. The structure unfolds from a storage position proximate the planar ironing surface of the ironing board in order to support the ironing board at a slightly elevated position during use. The ironing board may be supported upon a table top or like surface, but does not mount upon the lip of such a surface.

U.S. Pat. No. 2,637,919 for a SECTIONABLE COLLAPSIBLE PRESSING BOARD shows an ironing board which may be both collapsed and extended by telescoping of its members. The ironing board has a telescoping support base made of tubular material.

U.S. Pat. No. 2,746,186 for an SECTIONAL IRONING BOARD shows a small, foldable, ironing board having a mechanism suitable to mount the board to the open end of a bureau drawer. The mechanism clasps to the underside of the ironing board when the ironing board is folded. In this folded position the flat ironing surfaces are disposed against each other, leaving the mounting mechanism exposed to the exterior of the folded ironing board. This exposure is undesirable because the mechanism might snag clothes during transport of the ironing board in a suitcase.

U.S. Pat. No. 3,688,706 for a COMBINATION BREADBOARD AND IRONING BOARD shows a solid, rigid, ironing board having one side usable as a breadboard and an opposing side usable as an ironing board. The board is stored in the breadboard slot of a kitchen cabinet. In one variation a smaller version of the board mounts on an auxiliary piece of furniture, such as a cabinet, from which a drawer is removed.

Still additional issued United States patents generally show mounting systems for temporarily mounting a portable object in a position at, and extending into space beyond, the level lip of an independent structure. For example, U.S. Pat. Ser. No. 4,629,247 for an INFANT'S CHAIR shows a portable infant's chair that firmly fastens upon the lip of a table for stably holding an infant at the table. The supporting mechanism for the infant's chair engages the lip of the table at both its upper and lower surfaces. In order to compactly fold the infants chair for transport and storage the supporting mechanism is detached from the chair.

SUMMARY OF THE INVENTION

The present invention contemplates a foldable and portable ironing board that removably temporarily mounts to an independent structure that presents a substantially planar substantially level lip. In its mounted position the ironing board is strong and stable, and presents an easily accessible, appropriately sized and spatially unobstructed surface for the ironing of cloth. In its folded position the ironing board is compact with substantially regular and smooth external features. It is correspondingly readily transported and stored. The ironing board has as few as three major components, and is correspondingly economical of construction.

The preferred embodiment of a portable ironing board in accordance with the present invention includes, as a first component, a generally rectangular generally planar member having a flat top surface suitable to support cloth while it is ironed. The bottom of the member defines two elongate bores. Each bore is substantially spaced parallel to the other and to the flat top surface. Each bore is aligned substantially perpendicular to one edge side of the planar member. Each bore has an open end that is directionally disposed, along the length of the bore, oppositely to this one edge side.

The preferred embodiment of the ironing board further includes, as second and third components, two generally "U"-shaped elongate brace members. Each brace member is of complementary cross section to an associated one of the two elongate bores. Normally both braces are tubular and both bores are circular. A first end region of each brace member, corresponding to one leg of the "U", slides between greater and lesser insertion into a corresponding one of the two elongate bores. Resultantly, to this greater and lesser insertion a second end region of each brace member, corresponding to the other leg of the "U", slides between a first, extended, position extending beyond the edge of the planar member and a second, retracted, position substantially directly under the bottom of the planar member.

In operational use of the preferred embodiment of the ironing board, the planar member is removably temporarily mounted to a substantially planar substantially level lip of an independent structure, typically a table or other piece of furniture. A portion of the bottom of the planar member is supported flush upon a top surface of the lip while the two brace members, extended to their first positions, brace against a bottom surface of the lip. A remaining portion of the planar member extends into space beyond the edge of the lip. The edge of the lip constitutes a fulcrum. However, the mounted ironing board will not pivot about this fulcrum and topple off the structure's lip because the extended brace members prevent that it should do so.

Further in accordance with the present invention, the ironing board may be demounted from the lip and the two brace members may be compacted against the planar member. In order to be so compacted each elongate brace member is, at least at its retracted second positions, rotatable in its respective elongate bore. Each elongate brace member rotates from (i) its retracted position where the plane of its "U" is substantially perpendicular to the flat top surface of the planar member so that the brace member itself extends down and away from the bottom of the planar member to (ii) its storage position where the plane of its "U" is substantially parallel to the flat top surface. In its storage position each brace member is rotated to a position firmly against, or at least closely proximate to, the bottom of the planar member. The bottom of the planar member preferably presents a recess, or cavity, into which both elongate brace members are received when they are rotated into their storage positions.

In storing and transporting the preferred embodiment of the ironing board both elongate brace members are initially slid from their extended first to their retracted second positions whereat they are normally completely beneath the bottom of the planar member. Each elongate brace member in its retracted position is then independently rotated to its storage position against the bottom of the planar member. The planar member and the two brace members in their storage positions form a compact parallelepiped body that has no substantially irregular surfaces or rough edges.

Still further in accordance with the present invention, the portable ironing board is foldable. The foldable ironing board further includes, as a fourth component, a piano hinge located at that edge of the planar member that is opposite to its side edge from which the elongate brace members extend. A generally planar lengthening member, normally an elongate trapezoid in shape, is hinged to the planar member, which is generally rectangular in shape, by this hinge. When the planar lengthening member is unfolded from the rectangular planar member then both members establish a coplanar top surface upon which cloth may be ironed. The generally planar lengthening member folds to a storage position where its top surface is substantially flush against the top surface of the generally rectangular planar member. In its folded condition the ironing board is still in the shape of a compact parallelepiped body.

The mounting system in accordance with the present invention is susceptible of differing embodiments and adaptations. The elongate brace members need not have legs of coequal length, as in the general shape of a "U", but may instead each have a one leg, nominally the one that slides within the bore, that is shorter. The elongate brace members thereby assume the general shape of a "J". The mounting system in accordance with the present invention is not limited to supporting ironing boards from furniture. The system may be adapted to removably mount diverse portable objects in a position at, and extending into space over, the level lip of any independent structure that presents such a lip. Portable objects that may be so mounted include wings for tables, trays, glass and wine bottle holders, magazine holders, baskets and other containers, and infant's chairs.

These and other aspects and attributes of the present invention will become increasingly clear upon reference to the following drawings and accompanying specification.

BRIEF DESCRIPTION OF THE DRAWINGS

FIG. 1 is a perspective view showing the preferred embodiment of a portable and foldable ironing board in accordance with the present invention mounted in its operational position to an existing structure, nominally a table.

FIG. 2 is a side plan view showing the folding action of the preferred embodiment of a portable and foldable ironing board in accordance with the present invention.

FIG. 3 is a bottom plan view showing the sliding and the rotation of the brace members of the preferred embodiment of a portable and foldable ironing board in accordance with the present invention.

DESCRIPTION OF THE PREFERRED EMBODIMENT

Figure 4:
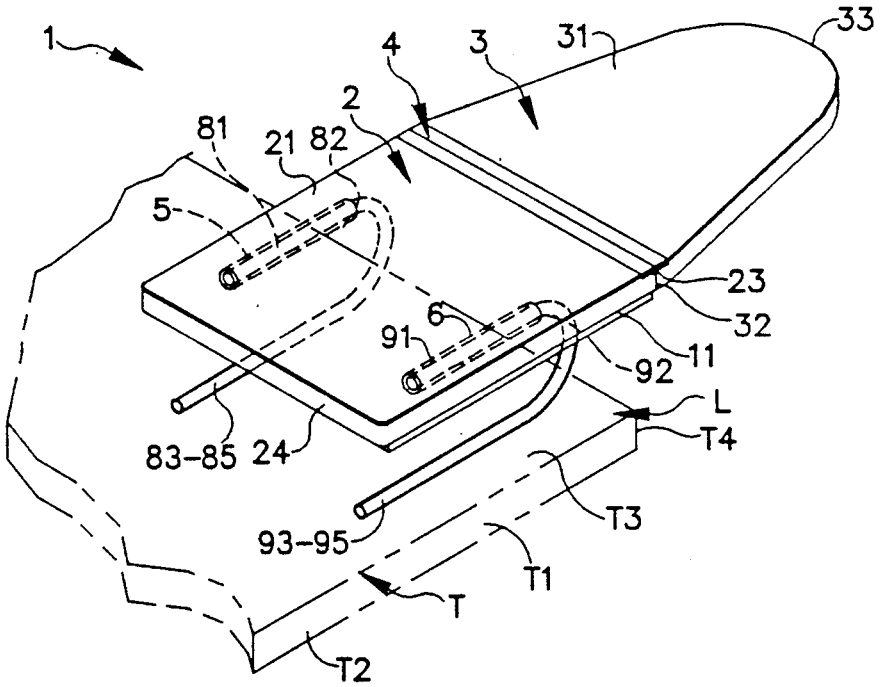

A preferred embodiment of a portable and foldable ironing board 1 in accordance with the present invention is generally shown in FIGS. 1–3. The ironing board 1 includes a first, generally rectangular, planar member 2 that is connected to a second, generally trapezoidal, planar member 3 by a piano hinge 4. When the ironing board 1 is unfolded then the upper surfaces 21, 31 of both the first and second planar member are aligned coplanar and present a flat top surface suitable to support cloth while it is ironed.

The coplanar alignment of first planar member 2 and second planar member 3 is established and maintained by the abutment of front edge side 23 of first planar member 2 against rear edge side 32 of second planar member 3. These edge sides 23, 32 need not be precisely perpendicular to coplanar surfaces 21, 31, but can instead be slightly tapered so as to promote that the second planar member 3 should be held level even when ironing pressure is applied at its distal end 33.

The pivot axis 41 of piano hinge 4 is normally along the line where surfaces and sides 21, 31, 23, 32 meet. Accordingly, in the folded position of ironing board 1 the top surface 31 of the second planar member 3 lies flush against the top surface 21 of first planar member 2.

Both planar members 2, 3 are typically made of molded thermoplastic, and more particularly of polyethylene or polypropylene. The piano hinge 4 is typically made of metal, but may be made of plastic or nylon. The hinge 4 may be a live hinge that is created when planar members 2, 3 are molded as a unitary assembly.

The bottom side 22 of the first planar member 2 is of complex geometry. The planar member 2 defines two elongate bores 5, 6. The bore 5 is substantially spaced parallel to the bore 6. This need not have been the case: the bores 5, 6 could angle towards each other in the direction opposite edge side 23.

Each of the bores 5, 6 is spaced parallel to the flat upper surface 21 of planar member 2. This parallelism is dictated more by the planar nature of member 2 than any substantive requirement that the bores must be precisely parallel to upper surface 21. The parallelism is useful, however, to hold ironing board 1 level when it is mounted to various thicknesses of the planar lip L.

Each of the bores 5, 6 is substantially perpendicular to edge 24 of planar member 2. Again this is not necessary: the bores 5, 6 could be disposed at a same angle other than 90°, or at multiple differing angles, relative to edge side 24. For example, consider the mounting of ironing board 1 at the corner of a rectangular table T so that it would extend along the line of one of the table's edge sides T1. The safest and steadiest engagement of brace members 8, 9 with the table's underside T2 would be expected only if the bore 6, and the resulting direction taken by the brace member 9 that fits within bore 6, was not perpendicular to edge side 24. A non-perpendicular bore 6 could avoid placing the tip 13 at the edge of rectangular table T when the ironing board 1 is mounted at its corner T4.

The bores 5, 6 do not extend the entire length of planar member 2, but preferably extend only part of such length and more preferably extend halfway. This preferred brace permits brace members 8, 9 both (i) to be securely retained within respective bores 5, 6 when fully inserted therein and (ii) to reside entirely under the bottom side 22 of planar member 2 when only partially inserted within bores 5, 6.

Two generally "U"-shaped elongate brace members 8, 9 both slide and rotate in the respective bores 5, 6. The brace members 8, 9 are preferably tubular and are typically made from strong steel or aluminum. They are typically ⅜" or larger in exterior diameter. A first portion 81, 91 of each elongate brace members 8, 9 constitutes a first leg of the "U". This portion 81, 91 slides between greater or lesser insertion into the corresponding bore 5, 6. As depicted in FIG. 1, the portions 81, 91 are fully inserted into the respective bores 5, 6.

The elongate brace members 8, 9 undergo an approximate 180° bend, forming the trough of the "U" at respective regions 82, 92. Remaining regions 83–85 and 93–95 constitute the remaining leg of each "U". The shape of the elongate brace members 8, 9 may alternatively be considered to be a "J", meaning a "U" having unequal lengths of its legs. In such a case shown in FIG. 4, the portions 81, 91 constitute the short leg of the "J" whereas the remaining portions 83–85 and 93–95 constitute the remaining, longer, leg of the "J".

The angular orientation and extent in three dimensional space of bores 5, 6 within planar member 2, and of the elongate brace members 8, 9, are obviously related. The relationship between bores 5, 6 and elongate brace members 8, 9 is dictated by the function of the elongate brace members 8, 9 to (i) slide and (ii) rotate within bores 5, 6 between deployed positions engaging table T1 to mount the ironing board 1 thereto (shown in FIG. 1), and storage positions (shown in dashed line for brace member 9 in FIG. 3). A natural tendency to assume that the bores 5, 6 and the brace members 8, 9 must be shaped, sized, and oriented substantially identically as shown in FIGS. 1–3 should avoided. The present invention contemplates several differing configurations of the planar member 2 and its bores 5, 6, and the brace members 8, 9, in accomplishing the dual functions of ironing board 1 both (i) to mount to lip L of table T and (ii) to compact for storage. For example, in the ensuing discussion it should be visualized how the ironing board 1 could still function if its brace members 8, 9 were in the shape of an "n" or "G".

The ironing board 1 is removably detachably mounted to the substantially planar substantially level lip L of a table, or other structure, T by the engagement of both first planar member 2 and each of the elongate brace members 8, 9 with the lip L. The first planar member 2 is supported on its bottom side 22 by contact with the top surface T3 of the lip L of table T. The elongate brace members 8, 9 brace against the bottom surface T2 of the lip L of table T. Gravitational force on the ironing board 1 in its erected position, and any additionally forces in a downwards direction due to the process of ironing, only serves to securely anchor and maintain the ironing board 1 in its mounted position on lip L.

In order to facilitate that the ironing board 1 should not slip while temporarily mounted upon lip L, and that it should not mar the top surface T3 or the bottom surface T2 of the table T, resilient and elastomeric pads, or strips, 10, 11 are affixed at the bottom side 22 of first planar member 2. Similarly, the proximal end portions 85, 95 of elongate brace members 8, 9 are capped with resilient and elastomeric caps 12, 13. Both the pads 10, 11 and the caps 12, 13 are typically made of synthetic rubber.

The folding action of the ironing board 1 in accordance with the present invention is shown in FIG. 2. The angle $\theta$ varies from approximately 180° in the unfolded condition to approximately 0° in the folded condition of ironing board 1. The second planar member 3 pivots about pivot axis 41 of hinge 4 until its upper surface resides substantially flush against the upper surface of first planar member 2. Both the second planar member 3 and first planar member 2 are generally of the same length so that folded position of ironing board 1 is optimally compact.

The manner by which elongate brace members 8, 9 may be drawn up into storage positions against the bottom side 22 of the first planar member 2 is shown in FIG. 3. Each of the elongate brace members 8, 9 is slid within its corresponding bore, 5, 6 until it is substantially directly under the bottom side 22 of first planar member 2. The position so assumed is called the retracted position of brace members 8, 9.

In this position each of the elongate brace members 8, 9 is rotated within its corresponding bore 5, 6 to assume a storage position. At its storage position the plane of each "U"-shaped elongate brace member 8, 9 is substantially parallel to the flat top surface 21, and the entire elongate brace member is closely proximate to the bottom side 22 of the first planar member 2. Each elongate brace member 8, 9 fits within a complementary shaped recess within the bottom side 22 of first planar member 2. In the preferred embodiment of ironing board 1 this recess is large and substantially coextensive with bottom side 22 of first planar member 2. The only sections of bottom side 22 that are not recessed preferably surround the bores 5, 6 and support the elastomeric pads 10, 11. A large recess saves weight.

In accordance with the preceding discussion certain adaptations and variations of the present invention will suggest themselves to a practitioner of the mechanical arts. The top surface of the planar members 2, 3 could be covered with a resilient ironing pad, including with a fitted ironing board pad. If such a pad was flexible, and not excessively thick (as would both be normal), then such ironing board pad could actually remain continuously affixed during transport, unfolded deployment, and folded storage of ironing board 1.

The use of the elastomeric pads 10, 11 need not be limited to the side edges of the bottom side 22 of the first planar member 2. Elastomeric pads could also be located at the edge of bottom side 22 adjacent rear edge side 24.

The elongate brace members 8, 9 need not be precisely in the shape of a "U" or "J", but could exhibit any form which permits that they should be both (i) slid and (ii) rotated between retracted and deployed positions.

A pivoting strut, or extension, could removably connect between elongate brace members 8, 9 (such as between their regions 84, 94) to hold the members 8, 9 at a fixed separation during deployment of ironing board 1. During the folding of elongate brace members 8, 9 against first planar member 2 such a strut would also lie against the bottom of planar member 2, or could alternatively be completely detached for convenient storage in a special bore, clip, or other storage location conveniently located on one of the planar members 2, 3.

In accordance with these and other possible adaptations and variations of the present invention, the present invention should be interpreted in accordance with the following claims, only, and not solely in accordance with that particular embodiment within which the invention has been taught.

What is claimed is:

1. An ironing board supportable on an independent structure presenting a substantially planar substantially level lip, the ironing board comprising:

a generally planar member having a substantially flat top surface and edge sides, the planar member defining an axial bore extending from an opening at an underside of the planar member towards an edge side of the planar member; and an elongate brace member having substantially in a plane a first end region slidingly positioned within the planar member's bore along the axis thereof, joined to a bend region external to the planar member's bore, joined to a second end region, extending from the bend region farther than does the first end region, the bore providing means to allow the second end region to move between a position in which it extends beyond the planar member's edge side when the first end region is slid relatively more deeply within the planar member's bore and a position in which it is retracted substantially adjacent to the underside of the planar member and does not extend beyond the planar member's edge when the first end region is slid relatively more shallowly within the planar member's bore so that while (i) the underside of the planar member rests upon the upper surface of a substantially planar substantially level lip of an external structure, with (ii) the edge side of the planar member positioned above the external structure and interiorly of its lip, then the brace member's second end region extending beyond the planar member's edge side will brace against the lower surface of the same lip, thereby supporting the ironing board from the lip of the external structure.

2. The ironing board according to claim 1 wherein the elongate brace member's first end region is rotatable in the elongate bore between a deployed position where the plane of the brace member is substantially perpendicular to the planar member's flat top surface, and a storage position where the plane of the brace member is substantially parallel to the planar member's flat top surface and the brace member is closely proximate to the underside of the planar member.

3. The ironing board according to claim 2 wherein the planar member defines and comprises:

an underside recess into which the elongate brace member is received in its storage position.

4. The ironing board according to claim 1 further comprising:

a hinge, connecting at an opposite edge side of the planar member to that edge side towards which the bore extends, for pivoting about a pivot axis at the opposite edge side; and a generally planar lengthening member, having a flat top surface, hinged to the planar member by the hinge for folding to a storage position substantially flush against the planar member and for unfolding to a deployed position so that the flat top surface of the planar member is lengthened.

5. The ironing board according to claim 4 wherein the hinge is connecting to the opposite edge side of the planar member along a line where it intersects the top surface of the planar member; and wherein the folding is to a storage position wherein the flat top surface of the planar member and the flat top surface of the lengthening member are oppositely juxtaposed.

6. The ironing board according to claim 4 wherein the lengthening member's flat top surface narrows in width opposite to its hinged connection to the planar member.

7. The ironing board according to claim 4 wherein the length of the planar member taken along an axis perpendicular to the pivot axis of the hinge is substantially equal to the length of the lengthening member.

8. The ironing board according to claim 1 further comprising:

resilient material affixed to the underside of the planar member;

wherein the resilient material contacts the upper surface of the lip when the planar member is temporarily mounted thereto.

9. The ironing board according to claim 1 wherein the elongate brace member is in the general shape of a "U", the brace member's first end region corresponding to one leg of the "U" and the brace member's second end region corresponding to the other leg of the "U".

10. The ironing board according to claim 1 wherein the elongate brace member is in the general shape of a "J", the brace member's first leg corresponding to the short upturned end region of the "J" and the brace member's second end region corresponding to the long leg of the "J".

11. A method of mounting an ironing board to a substantially planar substantially level lip of an independent structure, the method comprising:

rotating a generally "U"-shaped two-legged elongate brace member, having a first one of its two legs extending into a bore within, substantially parallel to the major surface of, and opening at an underside of, a substantially planar ironing board, within the planar ironing board's bore from a first, storage, position where a second leg is flush against the underside of the planar ironing board to a second, rotated, position where a plane of the "U" of the "U"-shaped brace member is substantially perpendicular to a plane of the planar ironing board while the second leg is substantially alongside the planar ironing board; and sliding the "U"-shaped elongated brace member within the ironing board'bore from its rotated second position in a direction so as to move that second leg outwards from its second position substantially alongside the ironing board until it assumes a third, deployed, position extending beyond an edge of the ironing board; and temporarily mounting the ironing board to a substantially planar substantially level lip of an independent structure by resting the underside of the planar ironing board upon a topside of the lip while the brace member in its extended deployed third position braces against an underside of the lip;

wherein the ironing board may be mounted extending into space from the lip of the external structure,

12. A portable device upon which to implement the ironing of cloth by an ironing instrument, the portable device supportable on an independent structure presenting a substantially planar substantially level lip, the portable device comprising:

a generally rectangular generally planar member having flat top surface suitable to support cloth while it is ironed, edge sides, and a bottom that defines two elongate bores, each bore (i) substantially spaced parallel to the other and to the flat top surface, (ii) aligned substantially perpendicular to a one edge side of the planar member, and (iii) having an open end that is directionally disposed, along the length of the bore, oppositely to said one edge side; and two elongate brace members, each of complementary cross section to one of the two elongate bores and each having a first end region that is slidingly positioned within one of said bores to allow movement of said first end region between greater and lessor insertion into a corresponding one of the two elongate bores while a second region which is joined to the first end region slides between a first position extending beyond the edge side of the planar member and a second position substantially directly under the bottom of the planar member;

wherein the planar member may be removably temporarily mounted to a substantially planar substantially level lip of an independent structure by supporting the bottom of the planar member upon a top surface of the lip while the two brace members in their first positions brace against a bottom surface of the lip.

13. The portable device according to claim 12 wherein the two elongate brace members are, at their second position, rotatable in the two elongate bores between a deployed position where the second end region of each brace member is substantially spaced apart from the planar member's flat top surface and a storage position where the second end region of each brace member is drawn closely proximate to the bottom of the planar member.

14. A system for temporarily mounting a portable object in a position at, and extending into space over, the level lip of an independent structure presenting a substantially planar substantially level lip, in order that, when mounted, the object may bear weight that is transferred to the lip and so that, when demounted, the object may be transported between the similar level lips of a number of independent structures, the temporary mounting system comprising:

a portable object defining a plurality of elongate bores, each such bore being substantially level when the portable object is positioned at a desired spatial orientation at, and extending over, a substantially planar substantially level lip of an independent structure, each such bore extending in a direction outwards from the lip of the independent structure to an opening that is, at such times as the portable object is mounted at the lip, extending into space over the lip; and a plurality of supporting members each for separately both sliding and also rotating within a corresponding one of the like plurality of elongate bores of the portable object to allow movement between a first, deployed, position where the portable object is mounted to the lip and a second, storage position where the portable object is demounted from the lip, each supporting member comprising:

a supporting rod having a first end region that is both slidingly and independently rotatingly mounted within an elongate bore and extends through the bore's opening, connected to a middle region where the rod bends back upon itself, connected to a second end region that is abutted against the under surface of the lip the elongate bore providing means to allow movement of the supporting rod regions to mount the portable object to the lip of the independent structure when the rod is both (i) slid deeply within the portable object's elongate bore and (ii) rotated to an unfolded position extending away from the portable object;

wherein the rod may be both (i) slid to a shallow position within the portable object's elongate bore and (ii) rotated to a folded position against the portable object in order to demount the portable object from the lip and in order to demount the portable object from the lip and in order to reduce a combined spatial volume of the portable object and the plurality of supporting members for transport.

* * * * *